United States Patent [19]

Flemming et al.

[11] Patent Number: 4,878,601

[45] Date of Patent: Nov. 7, 1989

[54] LIQUID DISPENSER

[76] Inventors: J. Peter Flemming, R.D. #2, 6 Cleveland Road West, Princeton, N.J. 08540; Robert J. Dee, 338 S. 3rd St., Philadelphia, Pa. 19106

[21] Appl. No.: 156,729

[22] Filed: Feb. 17, 1988

Related U.S. Application Data

[63] Continuation-in-part of Ser. No. 156,439, Feb. 16, 1988, abandoned.

[51] Int. Cl.[4] ..... B65D 85/44

[52] U.S. Cl. ..... 222/137; 222/144.5; 222/318; 222/330; 222/333; 222/380

[58] Field of Search ..... 222/383, 380, 375, 340, 222/318, 309, 144.5, 134, 135, 63, 333, 334, 137, 376, 431, 330, 424, 571

[56] References Cited

U.S. PATENT DOCUMENTS

| | | | |
|---|---|---|---|
| 2,905,361 | 9/1959 | Noall | 222/334 X |
| 3,349,962 | 10/1967 | Levin | 222/137 X |
| 3,830,405 | 8/1974 | Jaeger | 222/334 X |
| 3,890,922 | 6/1975 | Nordenholt | 222/334 X |
| 4,212,413 | 7/1980 | Barber, Jr. et al. | 222/334 X |
| 4,314,653 | 2/1982 | Sindoni | 222/137 X |
| 4,371,096 | 2/1983 | Scholl et al. | 222/334 X |

*Primary Examiner*—Joseph J. Rolla
*Assistant Examiner*—Gregory L. Huson
*Attorney, Agent, or Firm*—Joel F. Spivak

[57] ABSTRACT

A liquid dispenser for selectively dispensing a plurality of different liquids includes a separate reservoir for each of the fluids, and a separate nozzle for dispensing each of the fluids. A separate hydraulic dispensing system having a cylinder containing a piston is connected to each reservoir and nozzle for removing fluid from each reservoir and feed the liquid to the respective nozzle. A single hydraulic operating system including a cylinder containing a piston is connected to each dispensing cylinder to selectively operate the piston in each dispensing cylinder. The piston in the operating cylinder is operated by an electric motor having a threaded shaft, a nut on the threaded shaft and a drive arm on the nut. The drive arm is connected to the piston in the operating cylinder to move the piston a selected distance and thereby dispense a selected amount of liquid from a selected nozzle. Alternatively, the drive arm on the nut can be connected directly to the piston in the dispensing system.

9 Claims, 4 Drawing Sheets

LIQUID DISPENSER

This is a continuation-in-part of my co-pending application Ser. No. 156439, filed 2/16/88 and now abandoned entitled LIQUID DISPENSER.

The present invention relates to a liquid dispenser for such liquids as paint pigments, toners, etc., and more particularly to a hydraulically operated liquid dispenser.

BACKGROUND OF THE INVENTION

There are a number of applications for liquid dispensers which dispense a controlled amount of the liquid. In paint stores, paint pigments are mixed accurately to a formula to create various color tones. Therefore, it is necessary to have a dispenser which can dispense controlled amounts of different color pigments easily and quickly. Existing paint pigment dispensers are of two general classes. The first class is a multi-channel gear pump. In this device a gear exerts a constant pressure to a pump piston and a valve is opened for a known time. Since pressure is controlled by the gear and the time the valve is open is known, an approximately known amount of pigment is dispensed. The second class of existing systems is a multi-channel device in which a plurality of pistons and valves are provided which are actuated by motors. Since each piston displaces a known volume, a known amount of pigment is dispensed. While this class of system is precise, it is inordinately expensive to manufacture. pigment is dispensed. While this class of system is precise, it is inordinately expensive to manufacture.

Both of these systems seem to have disadvantages as far as accuracy is concerned. Both are predominately mechanical so as to be both expensive and unreliable. Also, neither are easily amenable to computer control. Therefore, it would be desirable to have a liquid dispenser which can accurately dispense a plurality of different liquids, which is relatively inexpensive, and which is amenable to computer control.

SUMMARY OF THE INVENTION

It is an object of the present invention to provide a system for dispensing liquids, particularly paint pigments, which is more accurate than prior art systems but which is substantially less expensive to manufacture and more reliable.

This object is achieved by a liquid dispenser which includes a reservoir for containing the liquid to be dispensed, and a nozzle connected to the reservoir for dispensing the liquid. Hydraulic dispensing means is connected to the reservoir and the nozzle for removing some of the liquid from the reservoir and delivering the liquid to the nozzle. Operating means is connected to the hydraulic dispensing means for operating the hydraulic dispensing means. Control means is connected to the operating means to deliver a controlled amount of liquid to the nozzle. The dispenser may include a plurality of reservoirs each with its own nozzle and hydraulic dispensing means. The operating means is connected to all of the hydraulic dispensing and suitable valves are provided so as to be able to selectively dispense liquid by any one of the hydraulic operating means.

DETAILED DESCRIPTION OF PREFERRED EMBODIMENT

Figure 1:
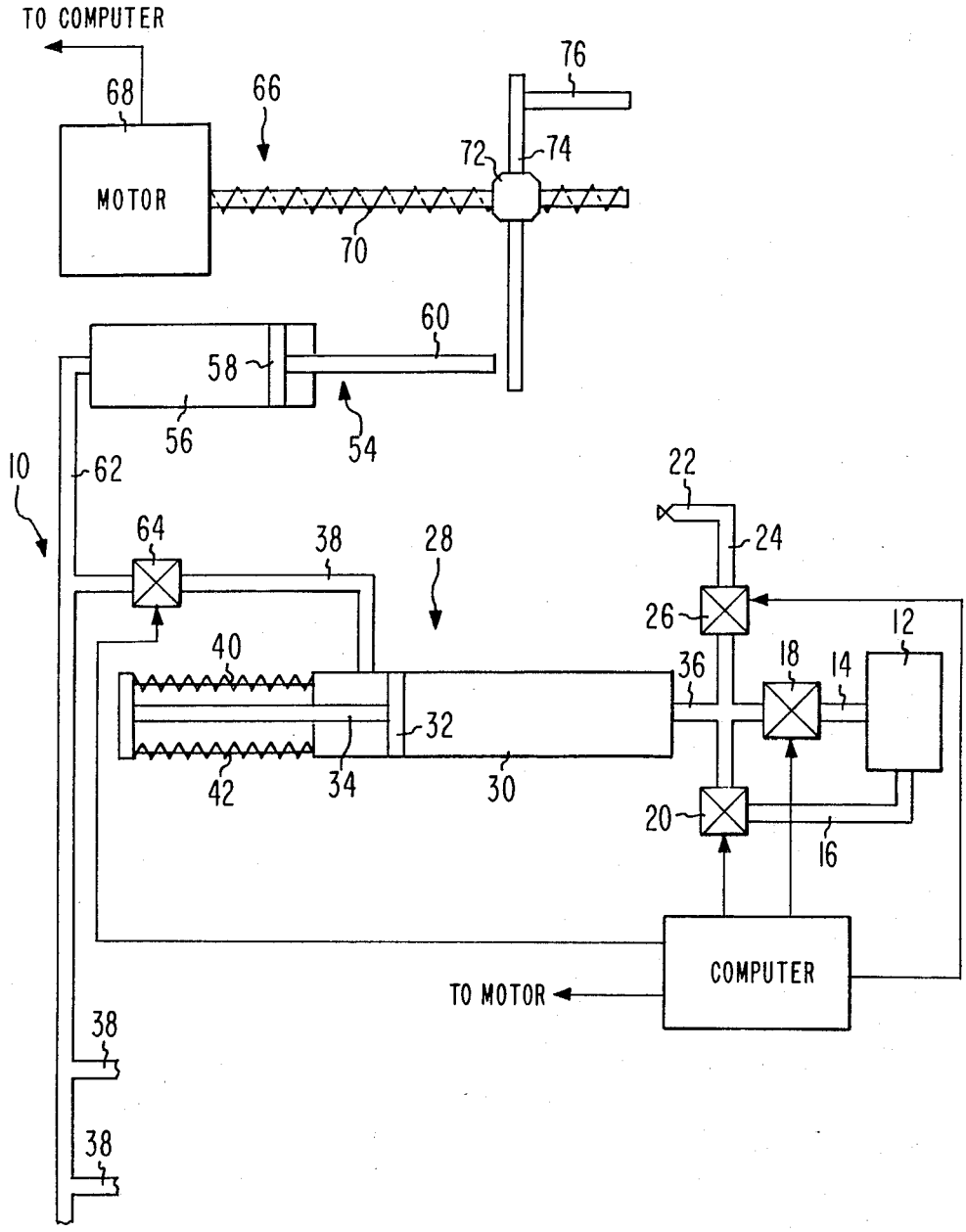
FIG. 1 is a schematic showing of the liquid dispenser of the present invention.

Referring initially to FIG. 1, the liquid dispenser of the present invention is generally designated as 10. Liquid dispenser 10 includes a reservoir 12 which contains the liquid to be dispensed. The reservoir 12 has an outlet pipe 14 and a return pipe 16. Electrically operated valves 18 and 20 are provided in the outlet pipe 14 and return pipe 16 respectively. A liquid dispensing nozzle 22 is connected to the reservoir outlet pipe 14 by a pipe 24 having an electrically operated valve 26 therein.

A hydraulic dispensing system 28 is connected to the reservoir 12 and nozzle 22. The hydraulic dispensing system 28 includes a cylinder 30 having a piston 32 therein and a piston rod 34 connected to the piston 32 and extending from one end of the cylinder 30. A liquid inlet/outlet pipe 36 extends from the other end of the cylinder 30 and is connected to the reservoir inlet and return pipes 14 and 16 and the nozzle pipe 24. A hydraulic fluid inlet/outlet pipe 38 extends from the cylinder adjacent the end from which the piston rod 34 extends.

Figure 2:
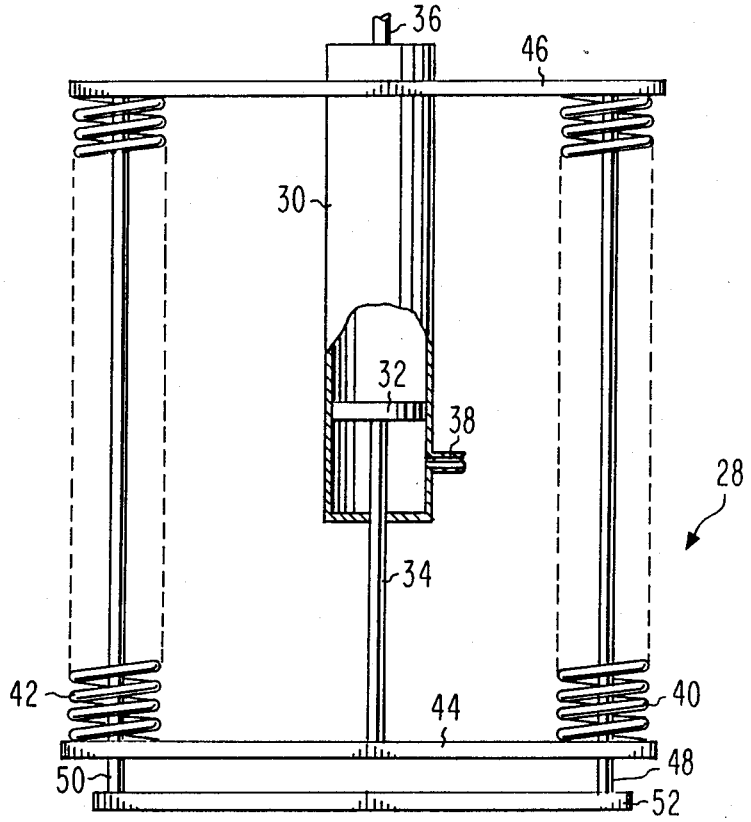
FIG. 2 is a schematic showing of the hydraulic dispenser system of the liquid dispenser of the present invention.

As shown in detail in FIG. 2, the piston 32 is spring loaded by a pair of springs 40 and 42. A plate 44 is connected to the end of the piston rod 34 and extends perpendicularly thereto. The springs 40 and 42 are compressed between opposite ends of the plate 44 and a fixed plate 46 which extends perpendicularly with respect to the cylinder 30 adjacent the other end of the cylinder 30. Thus, the springs 40 and 42 tend to push the piston 32 away from the liquid inlet/outlet pipe 36. Separate rods 48 and 50 extend through the springs 40 and 42 respectively. The rods 48 and 50 are secured at one end to the fixed plate 46. The rods 48 and 50 project beyond the movable plate 44 and are secured to a stop plate 52 which extends across the side of the movable plate 44 away from the cylinder 30.

A hydraulic operating system 54 is connected to the hydraulic dispensing system 28. The operating system includes a cylinder 56 having a piston 58 therein and a piston rod 60 connected to the piston 58 and extending from one end of the cylinder 56. The cylinder 56 has a hydraulic fluid inlet/outlet pipe 62 extending from its other end. The inlet/outlet pipe 62 is connected to the hydraulic fluid inlet/outlet pipe 38 of the dispensing system cylinder 30 through an electrically controlled valve 64.

A control system 66 drives the hydraulic operating system 54. The control system 66 includes a motor 68 having a threaded drive shaft 70. A nut 72 is threaded on the drive shaft 70 and a drive arm 74 is mounted on the nut 72. The drive arm 74 extends across the end of the piston rod 60. A stop member 76 is on the side of the drive arm 74 opposite the piston rod 60. Thus, rotation of the drive shaft 70 in one direction will move the drive arm 74 against the piston rod 60 and move the piston 58 into the cylinder 56 toward the inlet/outlet pipe 62. Rotation of the drive shaft 70 in the opposite direction moves the drive arm 74 away from the piston rod 60 and allows the piston 58 to move away from the inlet/-outlet pipe 62 under the action of springs in the operating system. The stop member 76 limits the movement of the drive arm 74 away from the piston rod 60.

In a dispenser 10 for dispensing a plurality of different liquids, the inlet/outlet pipe 62 of the operating system cylinder 56 is connected to the inlet/outlet pipes 38 of a plurality of different hydraulic dispensing systems, not shown. Each of the hydraulic dispensing systems, like the hydraulic dispensing system 28, includes a cylinder connected to a reservoir and a nozzle.

In the operation of the dispenser 10, there are four basic operations: home, dispense, recharge, and purge. The home sequence is needed to establish a known position for the motor 68 when the dispenser is started. The motor 68 is homed by moving it until the drive arm 74 pushes against the stop member 76. During this operation all of the valves 64 between the dispensing system cylinders 28 and the operating system cylinder 56, and the valves 18 between the reservoirs 12 and their respective dispensing system cylinders 28 are opened. This allows each dispensing system cylinder 28 to be fully retracted by its springs 40 and 42 until the spring plate 44 rests against the stop plate 52. The hydraulic coupling between the dispensing system cylinders 28 and the operating system cylinder 56 causes the piston 58 of the operating system cylinder 56 to be retracted. The position of the piston 58 when the system is homed depends on the amount of hydraulic fluid in the system and it will not in general bring the piston rod 60 into contact with the drive arm 74. The hydraulic fluid is not pressurized in the home position so that the system will not leak. FIG. 1 shows the dispenser 10 in the home position.

The dispense sequence starts with the motor 68 homed. For this sequence the valve 64 between the operating system cylinder 56 and the dispensing system cylinder 30 for the particular fluid to be dispensed is opened. The valve 18 is opened to connect the reservoir 12 to the dispense system cylinder 30. The motor 68 is operated to move the drive arm 74 against the piston rod 60 and move the piston 58 a short distance, no more than about one inch. This will cause the piston 32 of the dispense cylinder 30 to move and pump some volume of the liquid in the dispense cylinder 30 back into the reservoir 12. The hydraulic system will then be pressurized by the spring mechanism and any backlash will be preloaded. Also, the seals in the pistons will be pressed into position for forward motion of the pistons, this if the predispense motion.

The valve 18 between the dispense cylinder 30 and the reservoir 12 is then closed and the valve 26 between the dispense cylinder 30 and the nozzle 22 is opened to connect the nozzle 22 to the dispense cylinder 30. The motor 68 is then operated to move the piston 58 in the operating cylinder 56 a predetermined distance. This, in turn, causes the piston 32 in the dispense cylinder 30 to move a corresponding distance and thereby dispense a corresponding amount of liquid from the nozzle 22. The amount of movement of the motor 68 to achieve the dispensing of a desired amount of liquid is determined by precalibrating the system. The motor 68 is then operated through a sequence to move the piston 32 in the dispense cylinder 30 back slightly, then forward slightly, and then quickly back a very short distance. This results in any liquid in the nozzle 22 be sucked back into the nozzle 22 including any drops of liquid on the edge of the nozzle 22 to prevent any dripping of the liquid from the nozzle 22 after the dispensing is completed. The valve 26 between the nozzle 22 and the dispense cylinder 30 is then closed.

The recharge sequence always follows a dispense sequence. For this sequence, the valve 18 between the reservoir 12 and the dispense cylinder 30 is opened to allow liquid to be drawn from the reservoir 12 into the dispense cylinder 30. The motor 68 is operated to return it to its original home position and allow the springs 40 and 42 of the dispense system 28 to return the piston 32 in the dispense cylinder 30 to its original position. This pulls the liquid from the reservoir 12 into the dispense cylinder 30 and thus recharges the dispense cylinder 30. The valves 64 and 18 are then closed.

The purge sequence is needed to prevent clogging of the various pipes, and, when dispensing paint pigments, to prevent the pigments from setting. This sequence begins with the system in the home position. The valve 64 between the operating cylinder 56 and the dispense cylinder 30 to be purged is opened and the valve 20 in the return pipe 16 of the associated reservoir 12 is opened. The motor 68 is then operated to move the piston 32 of the dispense cylinder 30 through its maximum stroke and thereby pump liquid back to the top of the reservoir 12. This circulates the liquid through all parts of the dispense system 28 except the nozzle 22 and its pipe 24. The nozzle 22 and its pipe 24 can be cleared, if necessary, by a small sacrificial dispense operation. After the purge sequence, a recharge sequence is performed to refill the dispense cylinder 30.

Since all of the operating mechanisms of the dispenser 10, the motor 68 and valves 18, 20 and 64, are all operated electrically, the dispenser 10 can be operated by means of a computer 69. The computer 69 can be programmed to control the sequence of operation of the motor and valves, which valve 64 is opened to dispense a particular fluid, and the operation of the motor to achieve a desired quantity of the fluid dispensed.

Figure 3:
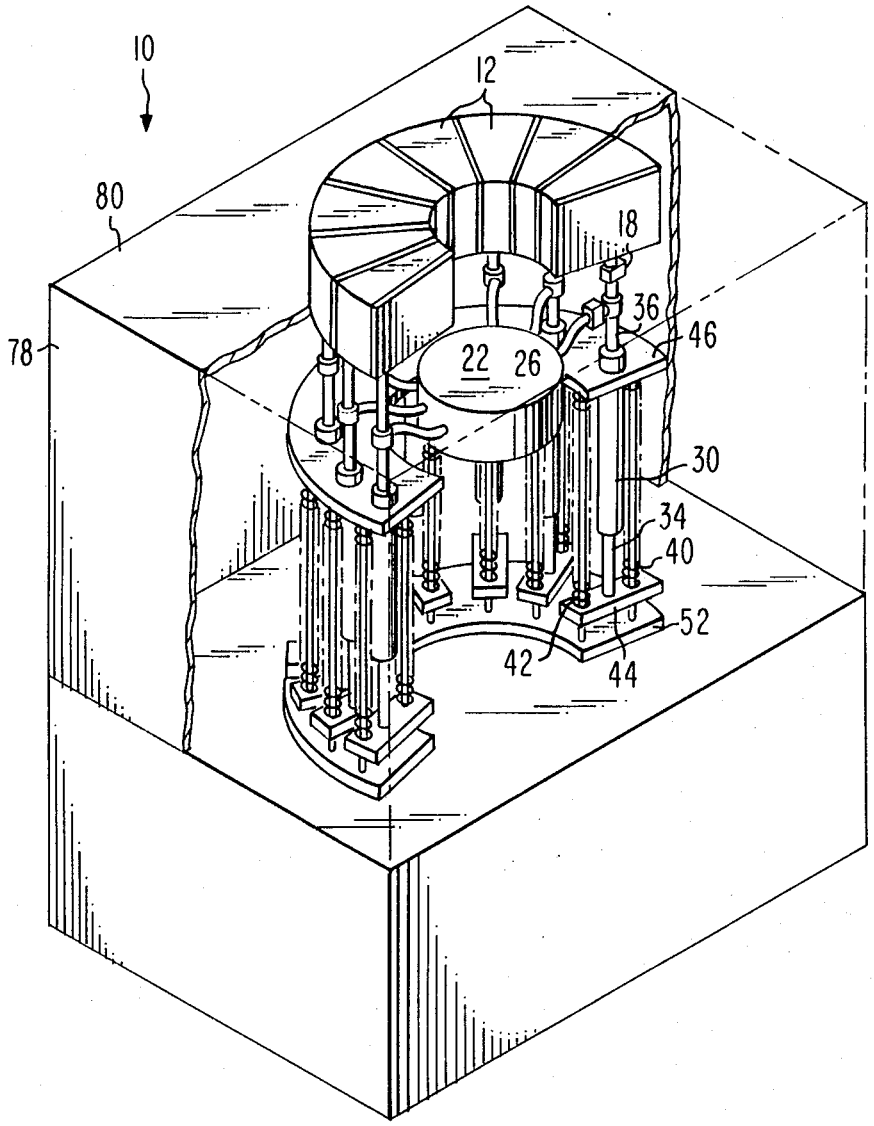
FIG. 3 is a perspective view of one form of the liquid dispenser of the present invention.

Referring to FIG. 3, there is shown a form of the liquid dispenser 10 of the present invention. The dispenser 10 includes a housing 78 with the reservoirs 12 mounted on the top 80 thereof. As shown, the reservoirs 12 are arranged in a semi-circle. Within the housing 78, the dispensing cylinders 30 are mounted vertically on so as to be arranged in a semi-circle corresponding to the arrangement of the reservoirs 12. The dispensing cylinders 30 are positioned with the piston rods 34 projecting from the bottom of the cylinder 30 and the inlet/outlet pipes 36 being at the top of the cylinders 30. The springs 40 and 42 for each dispense cylinder 30 are arranged along the sides of the dispense cylinder 30. The inlet/-outlet pipe 36 of each dispense cylinder 30 is connected through a valve 18 to its respective reservoir 12 which is directly above it.

Figure 4:
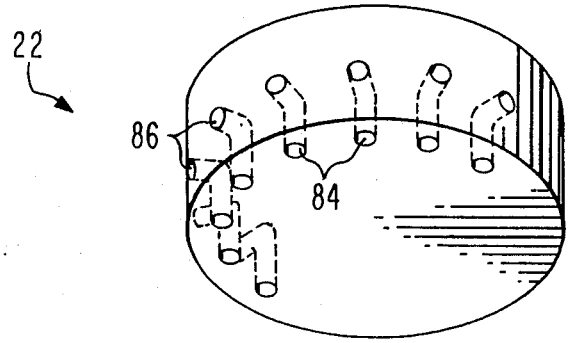
FIG. 4 is a perspective view of a nozzle which can be used in the liquid dispenser shown in FIG. 3.

The inlet/outlet pipe 36 of each dispense cylinder 30 is also connected through a valve 26 to a nozzle 22 which is mounted in the housing 78 adjacent the top 80 and at the center of the semi-circle around which the dispense cylinder 30 are arranged. As shown in FIG. 4, the nozzle 22 is a circular block having a plurality of dispense openings 84 in its bottom surface and arranged around a semi-circle. A plurality of passages 86 extend radially through the nozzle from it outer periphery to the respective dispense openings. Each dispense cylinder 30 is connected to a separate one of the passages 86. Thus, the liquids from the reservoirs 12 can be dispense through the respective dispense openings 84 into a container which is mounted beneath the nozzle 22. The mechanisms of the operating system 54 can be mounted in the housing 78 behind the dispense cylinders 30.

Figure 5:
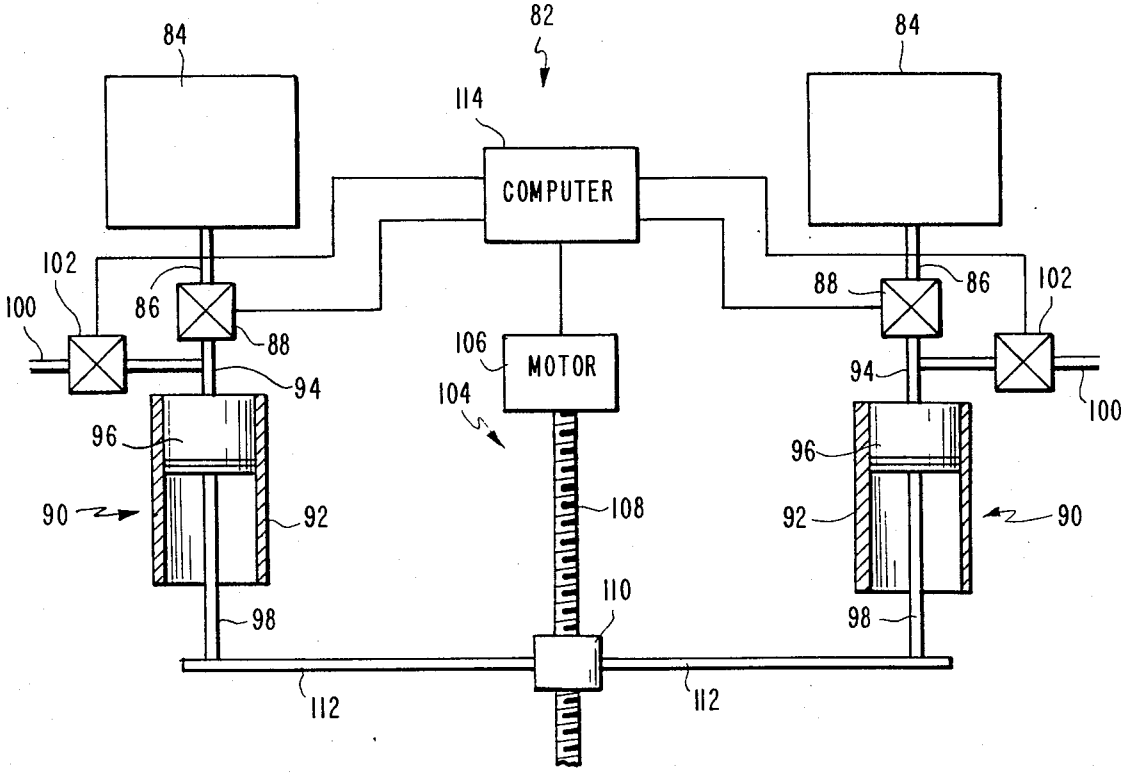
FIG. 5 is a schematic showing of a modification of the liquid dispenser of the present invention.

Referring to FIG. 5, a modification of the liquid dispenser of the present invention is generally designated as 82. Dispenser 82 includes a plurality of reservoirs 84, one for each color, each having an outlet pipe 86. An electrically operated valve 88 is in each of the outlet pipes 86. A separate hydraulic operating system 90 is connected to each reservoir through its respective valve 88. Each hydraulic operating system 90 includes a cylinder 92 having an inlet pipe 94 extending from one end and connected to a respective one of the valves 88. A piston 96 is in the cylinder 92 and has a piston rod 98 extending therefrom through the other end of the cylinder 92. A dispensing pipe 100 is connected to each of the cylinder inlet pipes 94 and extends to a nozzle, such as the nozzle 22 shown in FIG. 4. An electrically operated valve 102 is in each of the dispensing pipes 100.

A control system 104 is connected to all of the hydraulic operating systems 90. The control system 104 includes a stepper motor 106 having a threaded output shaft 108. A drive nut 110 is threaded on the shaft 108 and has drive arms 112 projecting therefrom. The drive arms 112 are connected to the piston rods 98 so that movement of the drive nut 110 along the shaft moves the pistons 96 in the cylinders 92. A computer 114 is electrically connected to the valves 88 and 102 and the motor 106 so as to control the operation of the valves and motor.

In the operation of the dispenser 82, such as to dispense a particular color pigment into a can of white paint, the computer 14 is provided with information as to the particular color pigment desired and the amount of the pigment desired. The computer causes all of the valves 88 to be opened and all of the valves 102 to the nozzle to be closed. The stepper motor 106 is rotated to move the drive nut 110 in the direction which moves all of the pistons 96 away from the cylinder inlet pipes 94 and thereby draw liquid from the reservoirs 84 into the cylinders 92. The drive nut 110 is moved a distance to draw into the cylinders 92 the desired amount of the pigment. The computer 114 then opens the valve 102 to the nozzle for the particular color to be delivered and closes the reservoir valve 88 for that color. The motor 106 is then rotated in the opposite direction to move the pistons 96 against the liquids in their respective cylinders 92. This forces the desired color pigment to the nozzle where it is delivered to the paint to be colored. The pigments in the other cylinders 92 are delivered back into their respective reservoirs 84.

Thus, there is provided by the present invention a liquid dispenser which is hydraulically operated. This minimizes the number of mechanical parts so as to achieve low manufacturing cost and high reliability. High dispense precision is achieved for dispensing a plurality of different fluids using only a single operating mechanism for all of the dispense systems. Also, the number of dispense systems can be simply varied to allow the construction of a dispenser which can dispense any number of desired different liquids. Since the operating parts are all electrically operated the dispenser is well suited for computer control.

What is claimed is:

1. A liquid dispenser comprising:

a plurality of reservoirs for containing different liquids to be dispensed;

a plurality of nozzles for dispensing the liquids from the reservoirs;

a plurality of dispensing cylinders each having a liquid inlet/outlet connected to a separate reservoir and a separate nozzle, and a hydraulic fluid inlet/-outlet;

a piston in each of said dispensing cylinders separating the liquid inlet/outlet from the hydraulic fluid inlet/outlet;

hydraulic operating means connected to the hydraulic fluid inlet/outlet of each of the dispensing cylinders for selectively operating the dispensing cylinders, said hydraulic operating means including a cylinder having a hydraulic fluid inlet/outlet at one end, a piston in said cylinder, and a piston rod connected to said piston and extending from the other end of the cylinder, the inlet/outlet of the operating cylinder being connected to the hydraulic fluid inlet/outlet of each of the dispensing cylinders; and means for operating the hydraulic operating means.

2. A liquid dispenser in accordance with claim 1 in which the means for operating the hydraulic operating means includes an electric motor having a threaded shaft, a nut threaded on said shaft, and a drive arm extending from said nut and adapted to engage the piston rod of the operating cylinder to move the piston toward the inlet/outlet of the operating cylinder.

3. A liquid dispenser in accordance with claim 2 including a valve between each reservoir and its respective dispensing cylinder, and a valve between each nozzle and its respective dispensing cylinder.

4. A liquid dispenser in accordance with claim 3 including a computer connected to the motor and the valves for selectively operating the motor and valve s to dispense a liquid from a selected reservoir.

5. A liquid dispenser comprising:

a reservoir for containing the liquid to be dispensed;

a nozzle for dispensing the liquid connected to said reservoir;

first hydraulic means for removing liquid from the reservoir and feeding the liquid to the nozzle including a first cylinder, a piston in said first cylinder, a liquid inlet/outlet pipe at one end of the first cylinder connected to said reservoir and said nozzle;

a first electrically operated valve between the reservoir and the first cylinder, a second electrically operated valve between the nozzle and the first cylinder and a third electrically operated valve in the hydraulic fluid inlet/outlet pipe of the first cylinder;

means for operating the first hydraulic means to feed a controlled amount of liquid to the nozzle;

second hydraulic means between the first hydraulic means and the means for operating the first hydraulic means including a second cylinder;

a piston in said second cylinder, a piston rod connected to said piston and extending from one end of the second cylinder, and a hydraulic fluid inlet/-outlet pipe extending from the other end of the second cylinder and connected to the hydraulic fluid inlet/outlet pipe of the first cylinder; and means for operating the second hydraulic means including an electric motor having a threaded shaft, a nut threaded on said shaft, and a drive arm mounted on said nut and extending across said piston rod of said second cylinder so as to be capable of moving the piston within said second cylinder.

6. A liquid dispenser in accordance with claim 5 including a stop member on the side of the drive arm opposite the second cylinder.

7. A liquid dispenser comprising:

a reservoir for containing the liquid to be dispensed;

a nozzle for dispensing the liquid connected to said reservoir;

first hydraulic means for removing liquid from the reservoir and feeding the liquid to the nozzle, said means including a first cylinder, a piston in said first cylinder, a liquid inlet/outlet pipe at one end of the first cylinder connected to said reservoir and said nozzle;

spring means connected to the piston in the first cylinder for moving said piston away from the liquid inlet/outlet pipe and wherein the piston in the first cylinder has a piston rod attached thereto and extending from the other end of the first cylinder, and the spring means and a first plate is attached to the piston rod, the first plate extending from the first cylinder perpendicular to the piston rod, and a pair of springs which are compressed between the first plate and a second plate fixedly mounted adjacent to one end of the first cylinder;

means for operating the first hydraulic means to feed a controlled amount of the liquid to the nozzle;

a first electrically operated valve between the reservoir and the first cylinder, and a second electrically operated valve between the nozzle and the first cylinder; a second hydraulic means between the first hydraulic means and the means for operating said first hydraulic means.

8. A liquid dispenser in accordance with claim 7 including a stop plate fixedly mounted across the first plate on the side of the first plate opposite the first cylinder.

9. A liquid dispenser in accordance with claim 8 in which the stop plate is supported on said second plate by rods extending through the springs.

* * * * *